US010660445B2

(12) United States Patent
Fang

(10) Patent No.: US 10,660,445 B2
(45) Date of Patent: May 26, 2020

(54) HEIGHT ADJUSTABLE CHAIR ARMREST

(71) Applicant: Tien Ching Fang, Tainan (TW)

(72) Inventor: Tien Ching Fang, Tainan (TW)

( * ) Notice: Subject to any disclaimer, the term of this patent is extended or adjusted under 35 U.S.C. 154(b) by 0 days.

(21) Appl. No.: 16/169,111

(22) Filed: Oct. 24, 2018

(65) Prior Publication Data

US 2020/0128964 A1 Apr. 30, 2020

(51) Int. Cl.
*A47C 7/54* (2006.01)

(52) U.S. Cl.
CPC ..... *A47C 7/541* (2018.08)

(58) Field of Classification Search
CPC ..... A47C 7/541
USPC ..... 297/411.36
See application file for complete search history.

(56) References Cited

U.S. PATENT DOCUMENTS 5,265,938 A * 11/1993 Melhuish ..... A47C 1/03 297/411.36
5,620,233 A * 4/1997 Corwin ..... A47C 1/03 297/411.36 X
6,062,647 A * 5/2000 Mei ..... A47C 1/03 297/411.36 X
6,336,680 B1 * 1/2002 Lee ..... A47C 1/03 297/411.36
6,419,323 B1 * 7/2002 Chu ..... A47C 1/03 297/411.35
6,460,932 B1 * 10/2002 Kopish ..... A47C 1/03 297/411.36 X
6,837,545 B1 * 1/2005 Ho ..... A47C 1/03 297/411.36
7,156,466 B1 * 1/2007 Chang ..... A47C 1/03 297/411.36 X
7,448,687 B2 * 11/2008 Tsai ..... A47C 1/03 297/411.36 X
7,533,939 B2 * 5/2009 Fookes ..... A47C 1/03 297/411.36
7,770,979 B2 * 8/2010 He ..... A47C 1/03 297/411.36
7,828,389 B2 * 11/2010 Oda ..... A47C 1/03 297/411.36 X
7,841,665 B2 * 11/2010 Geister ..... A47C 1/03 297/411.36
8,777,318 B2 * 7/2014 Chen ..... A47C 1/03 297/411.36
9,173,498 B2 * 11/2015 Colasanti ..... A47C 7/54
9,700,139 B2 * 7/2017 Su ..... A47C 1/03
2002/0043863 A1 * 4/2002 Roslund, Jr. ..... A47C 1/03 297/411.36

(Continued)

*Primary Examiner* — Rodney B White
(74) *Attorney, Agent, or Firm* — Rosenberg, Klein & Lee

(57) ABSTRACT

A height adjustable chair armrest includes an armrest top portion and a supporting member coupled with a chair body. The supporting member includes an outer tube and an inner tube received in the outer tube. The inner tube includes a plurality of positioning holes. A resilient member is mounted in the inner tube and includes a body and a resilient plate slantingly branching from the body. A first peg is disposed on the body and is releasably engaged in one of the plurality of positioning holes. An actuation rod is insertable through the outer tube into an operational hole of the body to press against or release the resilient plate. A rib is disposed on an inner periphery of the inner tube and is spaced from a top end of the inner tube by a spacing. The resilient member is restrained at a side of the rib.

2 Claims, 4 Drawing Sheets

(56) References Cited

U.S. PATENT DOCUMENTS

2005/0093359 A1* 5/2005 Hobb ..... A47C 1/03 297/411.36
2005/0146191 A1* 7/2005 Machael ..... A47C 1/03 297/411.36
2006/0250018 A1* 11/2006 Tsai ..... A47C 1/03 297/411.36
2007/0024100 A1* 2/2007 Chan ..... A47C 1/03 297/411.36
2007/0085402 A1* 4/2007 Hu ..... A47C 1/03 297/411.36
2007/0164595 A1* 7/2007 Chi ..... A47C 1/03 297/411.36
2008/0036264 A1* 2/2008 Pan ..... A47C 1/03 297/411.36
2008/0036265 A1* 2/2008 Pan ..... A47C 1/03 297/411.36
2008/0309140 A1* 12/2008 Ho ..... A47C 1/03 297/411.36
2009/0096271 A1* 4/2009 Tsai ..... A47C 1/03 297/411.36
2009/0184560 A1* 7/2009 Tsai ..... A47C 1/03 297/411.36
2010/0033005 A1* 2/2010 Lee ..... A47C 1/03 297/411.36
2010/0038950 A1* 2/2010 Lee ..... A47C 1/03 297/411.36
2010/0060065 A1* 3/2010 Hung ..... A47C 1/03 297/411.36 X
2010/0066147 A1* 3/2010 Tsai ..... A47C 1/03 297/411.36
2011/0221251 A1* 9/2011 Tsai ..... A47C 1/03 297/411.36
2011/0248542 A1* 10/2011 Tsai ..... A47C 1/03 297/411.36
2012/0098318 A1* 4/2012 Chen ..... A47C 1/03 297/411.36
2012/0104823 A1* 5/2012 Lai ..... A47C 1/03 297/411.36
2012/0205958 A1* 8/2012 Colasanti ..... A47C 1/03 297/411.36
2013/0033082 A1* 2/2013 Huang ..... A47C 1/03 297/411.36
2014/0183922 A1* 7/2014 Cvek ..... A47C 1/03 297/411.36
2015/0130250 A1* 5/2015 Masunaga ..... A47C 1/03 297/411.36
2016/0088946 A1* 3/2016 Bock ..... A47C 7/54 297/411.36
2019/0365108 A1* 12/2019 Deevers ..... A47C 7/541

* cited by examiner

HEIGHT ADJUSTABLE CHAIR ARMREST

BACKGROUND OF THE INVENTION

The present invention relates to a chair armrest and, more particularly, to a height adjustable chair armrest.

Chairs are a tool on which a human body can sit for taking a rest. To provide support for the arms of a user, armrests are disposed on a chair, particularly an office chair suitable for long-term use. However, conventional chair armrests are fixed and, thus, cannot be adjusted to fit different users of different heights for different needs.

Taiwan Utility Model No. M308021 discloses a stepless height adjustable armrest structure including an actuation portion coupled to a gear. When the actuation portion is press, the gear rotates through an angle of one or two teeth to achieve adjustment in the height corresponding to the angular travel of the gear, providing a slow adjustment. Repeated pressing of the actuation portion is required in case of a larger height adjustment, which is troublesome and uneasy.

Taiwan Utility Model No. M397204 discloses an armrest adjusting structure including an outer tube extending from an armrest and mounted around a base which is disposed on a chair seat and which has an inner tube. The inner tube includes an engaging seat having a guiding groove in which a positioning rod is movably received. Each of two sides of the guiding groove includes a row of teeth having protrusions and recesses for cooperating with a positioning portion of the positioning rod. A pivotal member is securely mounted on an end of the positioning rod. The end of the positioning rod can press against an elastic ring securely mounted around the outer tube. When the pivotal member is pivoted, the positioning portion of the positioning rod engages with or disengages from the grooves of the row of teeth, achieving adjustment of the height of the chair armrest. However, the armrest adjusting structure is complicated. For example, the inner tube includes the engaging seat having the guiding groove, leading to more complex members and increased manufacturing costs. Improvement is, thus, required.

BRIEF SUMMARY OF THE INVENTION

In view of the above drawbacks of the prior art, the present invention provides a height adjustable chair armrest including an armrest top portion and a supporting member mounted to an underside of the armrest top portion. The supporting member includes an engaging portion adapted to couple with a chair body. The supporting member includes an outer tube and an inner tube received in the outer tube. The inner tube includes a side having a plurality of positioning holes spaced from each other. Each of the plurality of positioning holes has an open end facing an interior of the inner tube. A resilient member is mounted in the inner tube and includes a body and a resilient plate slantingly branching from the body. A first peg is disposed on the body, extends perpendicularly to a compression and returning direction of the resilient plate, and is releasably engaged in one of the plurality of positioning holes via a respective opening. The body includes a top end having an operational hole. The outer tube includes a through-hole. An actuation member includes an actuation rod. The actuation rod is insertable into the through-hole and the operational hole to press against or release the resilient plate. A rib is disposed on an inner periphery of the inner tube and is spaced from a top end of the inner tube by a spacing. The resilient member is restrained at a side of the rib. The spacing provides the body with a larger operational space.

When it is desired to adjust the height of the armrest top portion, the actuation member is wrenched, such that the actuation rod causes pivotal movement of the body. Furthermore, the resilient plate is compressed against the inner periphery of the inner tube. Thus, the first peg disengages from the respective positioning hole via the respective opening. At this time, the outer tube can be pulled to a desired height, and the actuation member is then released. The first peg engages with another positioning hole under the returning action of the resilient plate, providing a positioning effect. By the above structure, the plurality of positioning holes with inwardly facing open ends is provided for cooperating with the first positioning peg of the body of the resilient member, and the resilient plate slantingly braches from the body of the resilient member to provide an elastic function. The structure is simpler and can be assembled at a lower cost without sacrificing the elastic operation, the height adjustment, and the positioning effect.

A rib is disposed on the inner periphery of the inner tube and is spaced from a top end of the inner tube by a spacing. Thus, the resilient member is restrained at a side of the rib, such that the resilient member can have a smaller volume to be received in the inner tube while providing desired elasticity.

The present invention will become clearer in light of the following detailed description of illustrative embodiments of this invention described in connection with the drawings.

DESCRIPTION OF THE DRAWINGS

FIG. 2A is an enlarged view of a circled portion of FIG. 2.

DETAILED DESCRIPTION OF THE INVENTION

Figure 1:
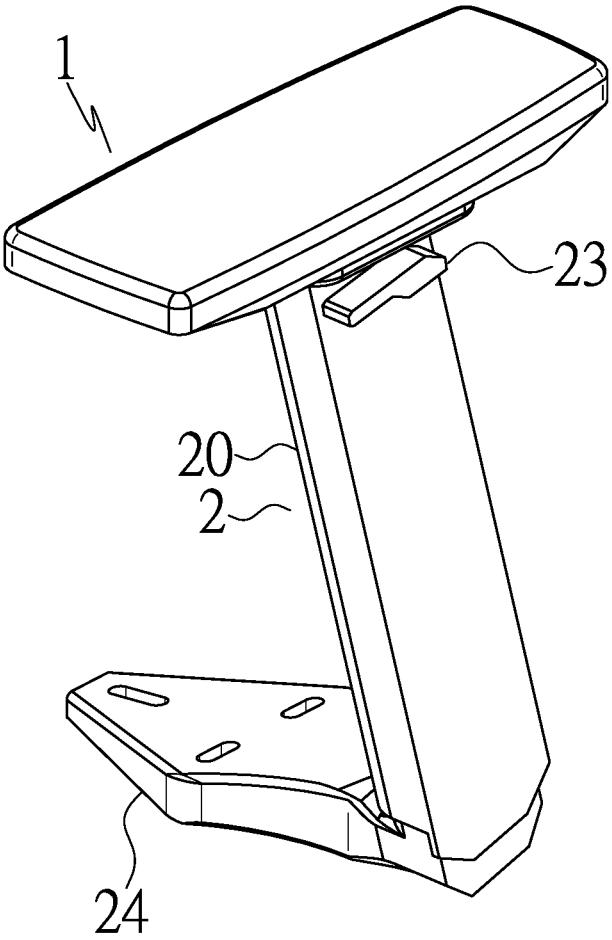
FIG. 1 is a perspective view of a height adjustable chair armrest according to the present invention.
Figure 2:
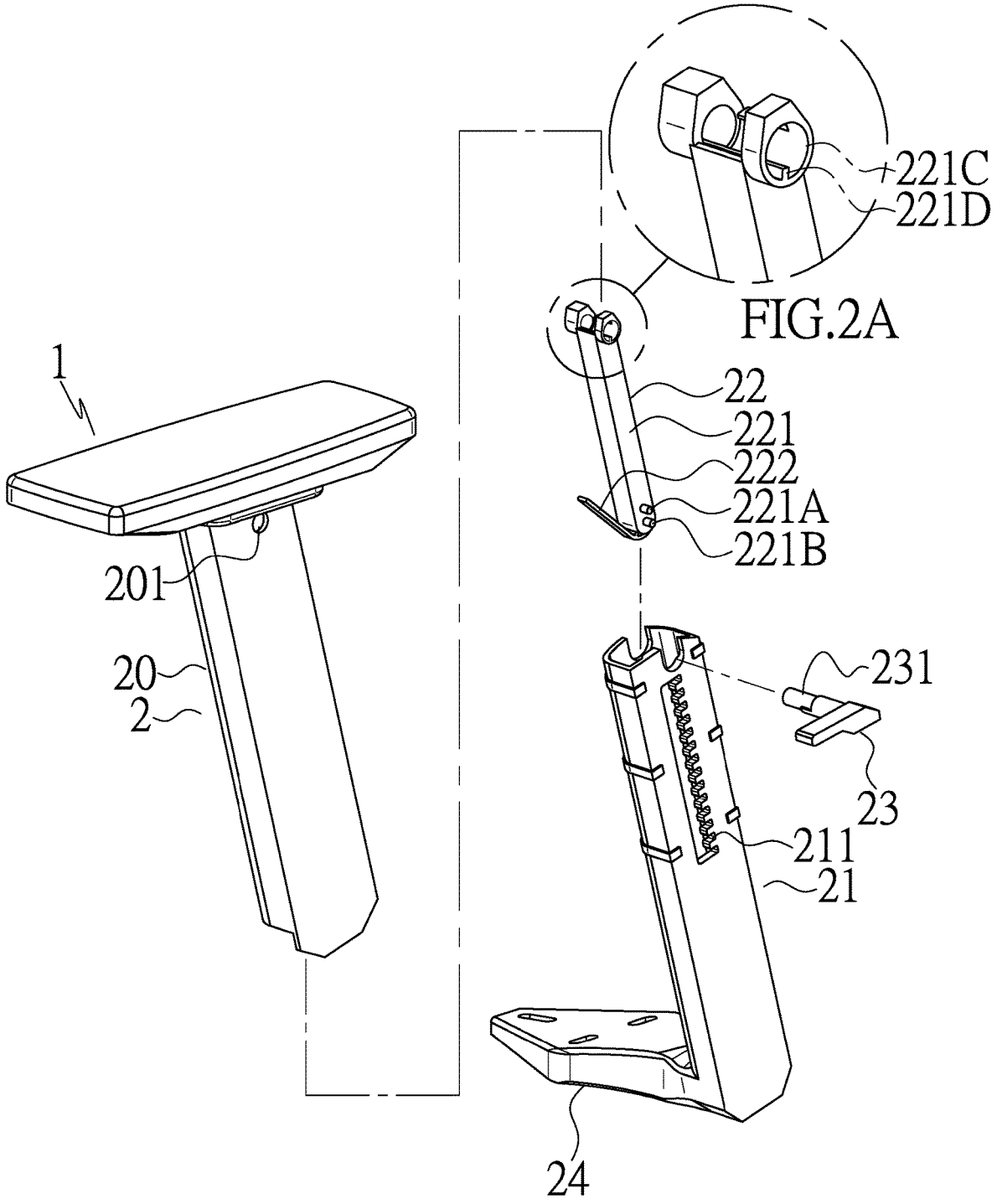
FIG. 2 is an exploded, perspective view of the height adjustable chair armrest according to the present invention.

With reference to FIGS. 1 and 2, a height adjustable chair armrest of an embodiment according to the present invention includes an armrest top portion 1 and a supporting member 2 mounted to an underside of the armrest top portion 1. The supporting member 2 includes an engaging portion 24 adapted to couple with a chair body.

The wherein the supporting member 2 includes an outer tube 20 and an inner tube 21 received in the outer tube 20. The inner tube 21 includes a side having a plurality of positioning holes 211 spaced from each other. Each of the plurality of positioning holes 211 has an open end facing an interior of the inner tube 21. A resilient member 22 is mounted in the inner tube 21 and includes a body 221 and a resilient plate 222 slantingly branching from the body 221. A first peg 221A is disposed on the body 221, extends perpendicularly to a compression and returning direction of the resilient plate 222, and is releasably engaged in one of the plurality of positioning holes 211 via a respective opening. The body 211 includes a top end having an operational hole 221C. The outer tube 20 includes a through-hole 201. An actuation member 23 includes an actuation rod 231. The actuation rod 231 is insertable into the through-hole 201 and the operational hole 221C to press against or release the resilient plate 222.

A key 221D is disposed on an inner periphery of the operational hole 221C. The actuation rod 231 includes a key groove 232 on an outer periphery thereof. The key 221D is insertable into the key groove 232, as shown in FIG. 4.

Figure 3:
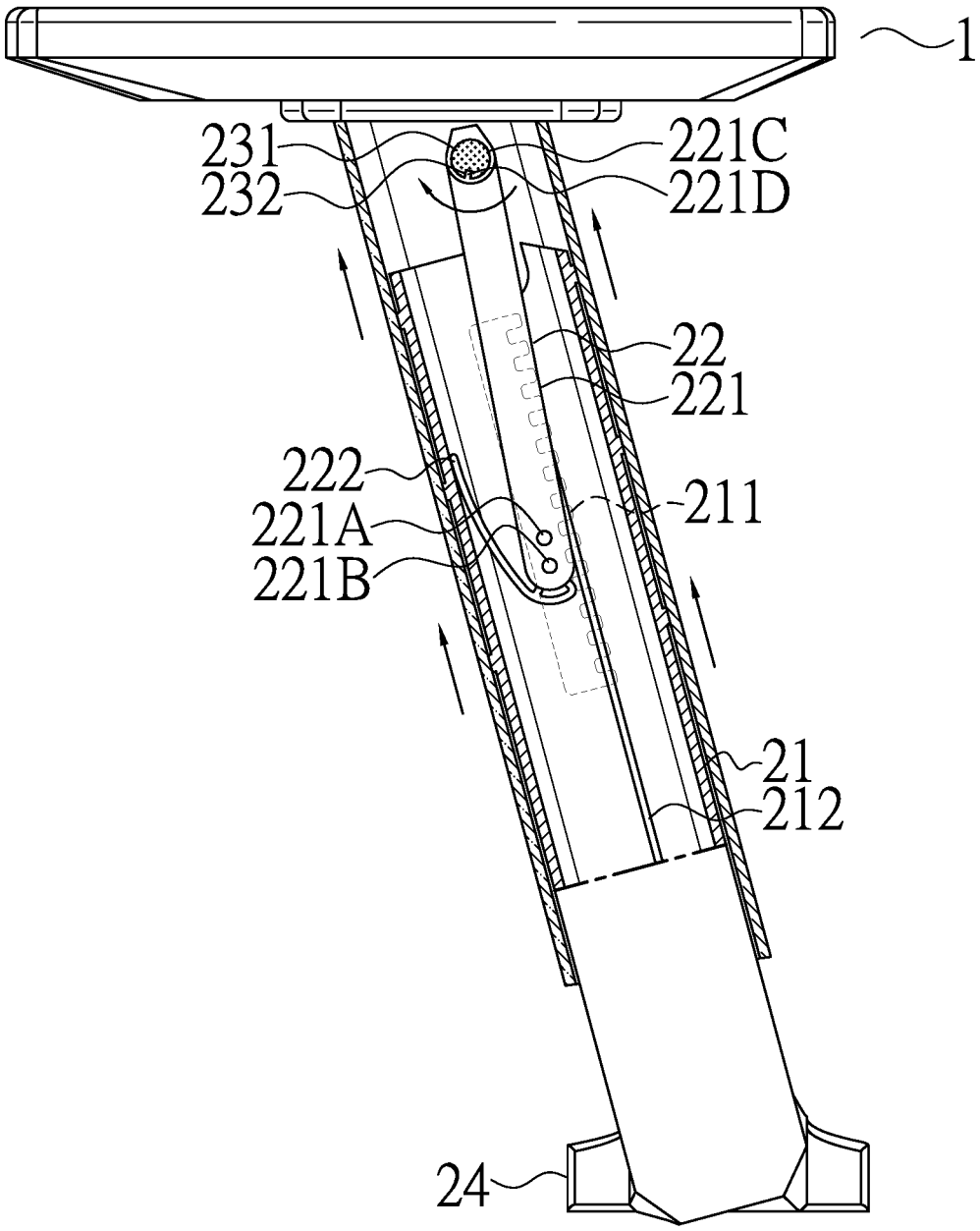
FIG. 3 is a cross sectional view illustrating height adjustment of the height adjustable chair armrest according to the present invention.
Figure 4:
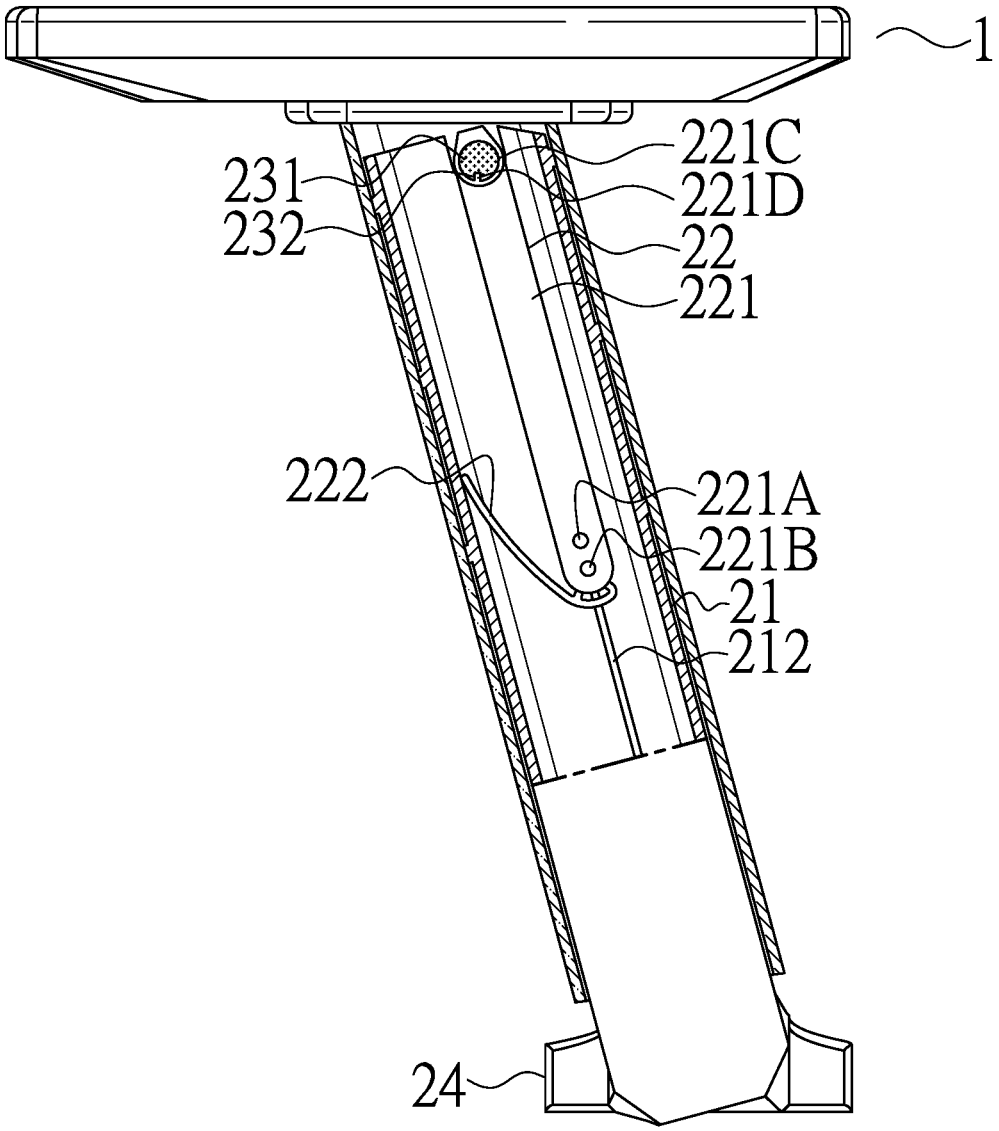
FIG. 4 is a cross sectional view illustrating positioning of the height adjustable chair armrest according to the present invention.

With reference to FIGS. 3 and 4, when it is desired to adjust the height of the armrest top portion 1, the actuation member 23 is wrenched, such that the actuation rod 231 causes pivotal movement of the body 221. Furthermore, the resilient plate 222 is compressed against the inner periphery of the inner tube 21. Thus, the first peg 221A disengages from the respective positioning hole 211 via the respective opening. At this time, the outer tube 20 can be pulled to a desired height, and the actuation member 23 is then released. The first peg 221A engages with another positioning hole 211 under the returning action of the resilient plate 222, providing a positioning effect.

In this embodiment, the body 221 further includes a second peg 221B adjacent to and spaced from the first peg 221A. The first peg 221A and the second peg 221B can simultaneously engage with two of the plurality of positioning holes 211 to provide a more stable and reliable positioning effect.

A rib 212 is disposed on the inner periphery of the inner tube 21 and is spaced from a top end of the inner tube 21 by a spacing. Thus, the resilient member 22 is restrained at a side of the rib 212, such that the resilient member 22 can have a smaller volume to be received in the inner tube 21 while providing desired elasticity. Furthermore, the restraining effect of the resilient member 22 provides structural stability. Furthermore, the spacing provides the body 221 with a larger operational space.

Although specific embodiments have been illustrated and described, numerous modifications and variations are still possible without departing from the scope of the invention. The scope of the invention is limited by the accompanying claims.

The invention claimed is:

1. A height adjustable chair armrest comprising an armrest top portion and a supporting member mounted to an underside of the armrest top portion, wherein the supporting member includes an engaging portion adapted to couple with a chair body, wherein the supporting member includes an outer tube and an inner tube received in the outer tube, wherein the inner tube includes a side having a plurality of positioning holes spaced from each other, wherein each of the plurality of positioning holes has an open end facing an interior of the inner tube, wherein a resilient member is mounted in the inner tube and includes a body and a resilient plate slantingly branching from the body, wherein a first peg is disposed on the body, extends perpendicularly with respect to a direction of compression and return of the resilient plate, and is releasably engaged in one of the plurality of positioning holes via a respective opening, wherein the body includes a top end having an operational hole, the operational hole having a key disposed on an inner periphery thereof, wherein the outer tube includes a through-hole, wherein an actuation member includes an actuation rod, wherein the actuation rod has a key groove on an outer periphery thereof and is insertable into the through-hole and the operational hole to press against or release the resilient plate, the key of the operational hole being inserted into the key groove when the actuation rod is inserted into the operational hole, wherein a rib is disposed on an inner periphery of the inner tube and is spaced from a top end of the inner tube by a spacing, wherein the resilient member is restrained at a side of the rib, and wherein the spacing provides the body with a larger operational space.

2. The height adjustable chair armrest as claimed in claim 1, wherein the body further includes a second peg adjacent to and spaced from the first peg.

* * * * *